US009568263B1

(12) United States Patent
O'Kelly

(10) Patent No.: US 9,568,263 B1
(45) Date of Patent: Feb. 14, 2017

(54) SELF-LOADING FIREARM WITH AUTOMATIC SLIDE AND MAGAZINE CATCH AND RELEASE

(71) Applicant: Daniel G. O'Kelly, Shady Shores, TX (US)

(72) Inventor: Daniel G. O'Kelly, Shady Shores, TX (US)

( * ) Notice: Subject to any disclaimer, the term of this patent is extended or adjusted under 35 U.S.C. 154(b) by 0 days.

(21) Appl. No.: 14/989,971

(22) Filed: Jan. 7, 2016

Related U.S. Application Data

(60) Provisional application No. 62/100,509, filed on Jan. 7, 2015.

(51) Int. Cl.
*F41A 17/38* (2006.01)

(52) U.S. Cl.
CPC ..... *F41A 17/38* (2013.01)

(58) Field of Classification Search
CPC ..... F41A 9/82; F41A 9/62; F41A 17/38; F41A 17/36
USPC ..... 89/138, 195, 196; 42/7, 70.02
See application file for complete search history.

(56) References Cited

U.S. PATENT DOCUMENTS 4,664,015 A * 5/1987 Kennedy ..... F41A 9/59 89/138
5,131,317 A * 7/1992 Meller ..... F41A 17/36 89/138
5,473,834 A * 12/1995 Bammate ..... F41A 17/38 42/50
9,097,474 B1 * 8/2015 Zins ..... F41A 5/04
2016/0109202 A1 * 4/2016 Weilharter ..... F41A 17/34 42/18

FOREIGN PATENT DOCUMENTS

WO WO 2016076931 A2 * 5/2016 ..... F41A 9/41

* cited by examiner

*Primary Examiner* — Reginald Tillman, Jr.
(74) *Attorney, Agent, or Firm* — Richard G. Eldredge

(57) ABSTRACT

A handgun includes a locking mechanism disposed within a thickness of a grip, the locking mechanism being configured to engage with a lever associated with a slider and a magazine carried within a cavity formed by the grip; and a spring-loaded lock pivotally attached to the frame and configured to engage with a lip on a side surface of the slider, the spring-loaded lock being configured to secure the slide in a fixed position when engaged with the lip. A method includes disengaging the magazine after all bullets therein are used via the locking mechanism; and releasing the slide as the new loaded magazine is placed in the cavity of the grip via the spring-loaded lock.

5 Claims, 3 Drawing Sheets

SELF-LOADING FIREARM WITH AUTOMATIC SLIDE AND MAGAZINE CATCH AND RELEASE

BACKGROUND

1. Field of the Invention

The present invention relates generally to self-loading firearms, and more commonly, to a handgun with an automatic slide and magazine catch system.

2. Description of Related Art

Self-loading firearms are well known in the art and are an effective means to provide protection and/or enjoyment to the shooter. In one commonly known embodiment, as depicted in FIG. 1, the handgun 101 includes a frame 103, a slide 105 and a grip 107. The slide 105 moves fore and aft relative to the frame 103, as indicated by arrow D11, during use.

A magazine 109 includes a frame 113 that forms a hollow cavity and a spring loaded follower 115 configured to slidingly engage with the hollow cavity. After all cartridges are fired, the follower reaches the lip 117 and engages with the slide 105, holding the slide 105 in the rearmost position, and at this point the magazine is subsequently removed from the cavity formed by grip 107 by pressing button 102, as depicted with arrow D13. After another loaded-magazine is placed into the cavity formed by the grip 107, a lever 111 is manipulated to release the slide 105 and return the slide 105 back to the firing position, as depicted in FIG. 1.

A problem commonly associated with self-loading firearms such as a handgun 101 is the time required to manipulate button 102, which removes the empty magazine, and then return the slide back to the closed position after the magazine 109 is reinserted in the cavity created by grip 107 by manipulating lever 111. This limitation can create significant issues, e.g., during a fast-paced gun fight.

Although great strides have been made in the area of self-loading firearms, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
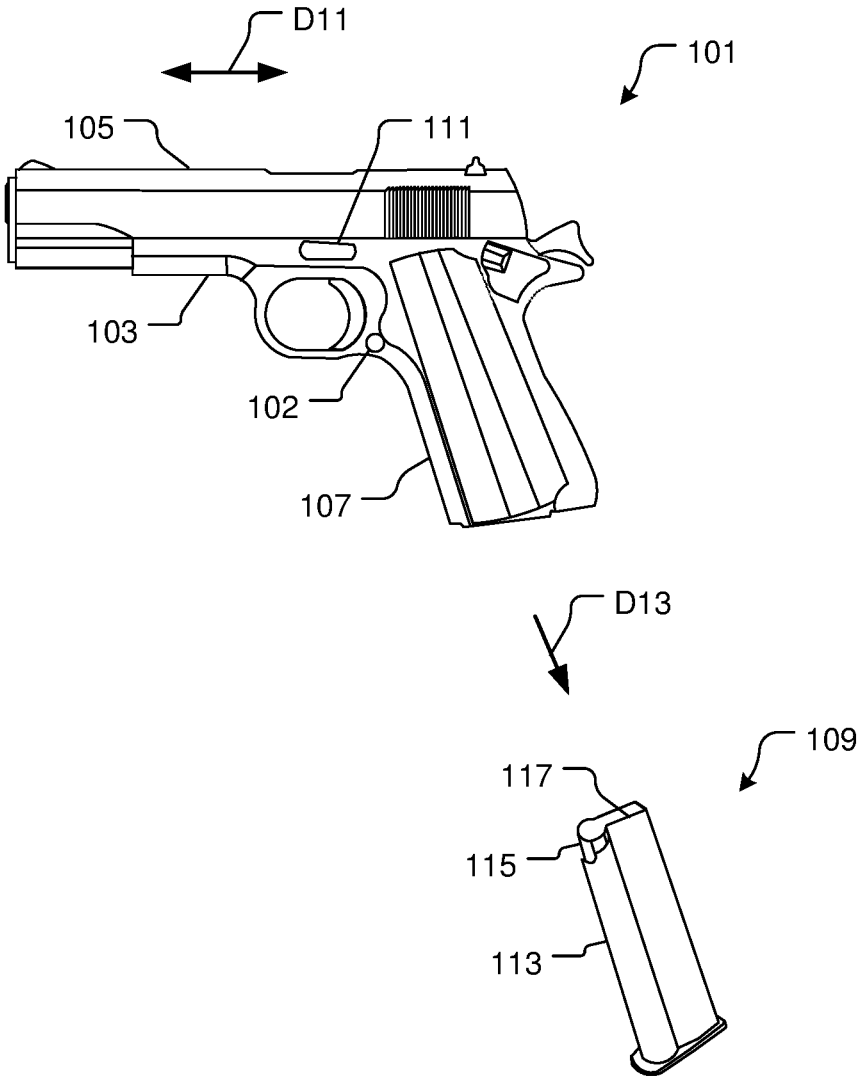
FIG. 1 (Prior Art)
FIG. 1 is a side view of a conventional handgun.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional handguns. Specifically, the handgun of the present application is configured to provide rapid and effective means to release the magazine after use and to automatically return the slide in the firing position after inserting a loaded magazine. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2B:
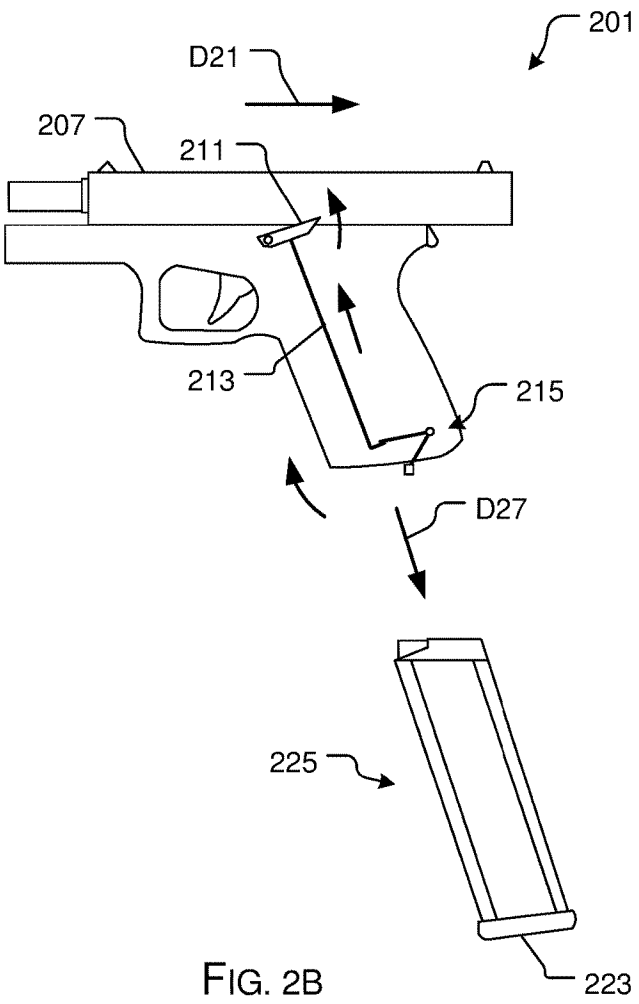
FIGS. 2A and 2B are left side views of a handgun in accordance with a preferred embodiment of the present application.
Figure 2A:
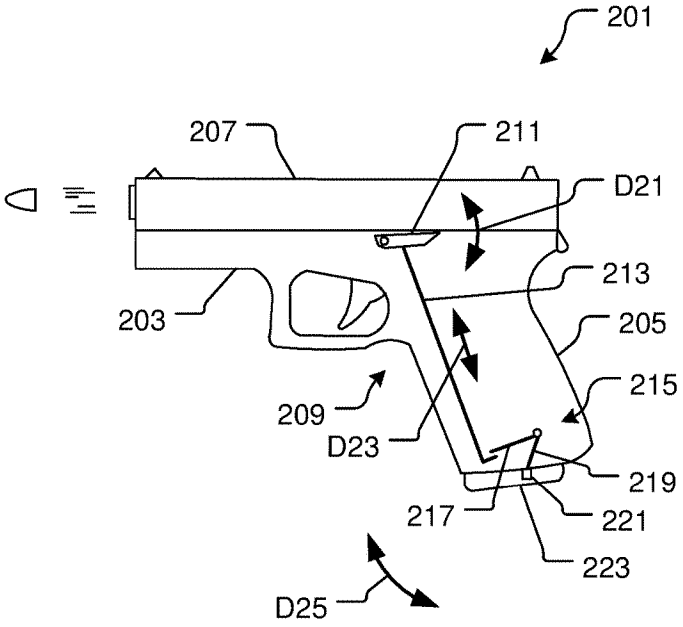

Referring now to the drawings wherein like reference characters identify corresponding or similar elements throughout the several views, FIGS. 2A and 2B depict left side views of a handgun 201 and a magazine system in accordance with a preferred embodiment of the present application. It will be appreciated that the handgun 201 overcomes one or more of the above-listed problems commonly associated with the conventional handguns.

In the contemplated embodiment, handgun 201 includes one or more of a frame 203 having a grip 205 with a slide 207 slidingly engaged thereto. During use, the slide 207 moves in direction D21 relative to the frame 203. This motion is caused by the exhaust gas from the bullet when fired. Like conventional handguns, the slide 207 returns back to the firing position, as shown in FIG. 2A, as additional cartridges are loaded in the chamber of the barrel.

One of the unique features believed characteristic of the present application is the use of a magazine link system 209 disposed within a thickness of the grip 205 and operably associated with a slide lever 211. During use, the link system 209 is configured to release the magazine from the interior cavity formed by the grip 205 after all cartridges are used. Thus, this feature provides the advantage of quickly releasing the magazine without the need to manipulate button 102, or any other switch/lever. It should be understood that the lever 211 pivots in direction D21 as the slide transitions between the closed and open positions. The link system 209 includes a first link 213 operably associated with lever 211 and configured to move in direction D23 as the link pivots in direction D21. The link 213 is configured to engage with a second link 215 having a first member 217 and a second member 219. The second link 215 is configured to pivot relative to grip 205 in direction D25. In one contemplated embodiment, an attachment device 221 is secured to second member 219 and is configured to engage the bottom section 223 of the magazine 225.

As depicted in FIG. 2B, slide 207 transitions to the open position after all cartridges are fired and the magazine 225 is automatically released via the link system 209. As depicted, the lever 211 is moved upwardly relative to the grip, which in turn pivots the second link in the relative direction. The movement of second link 215 causes the magazine 225 to disengage with the interior cavity created by the grip. The handgun is now ready for a second magazine to be reinserted.

Figure 3B:
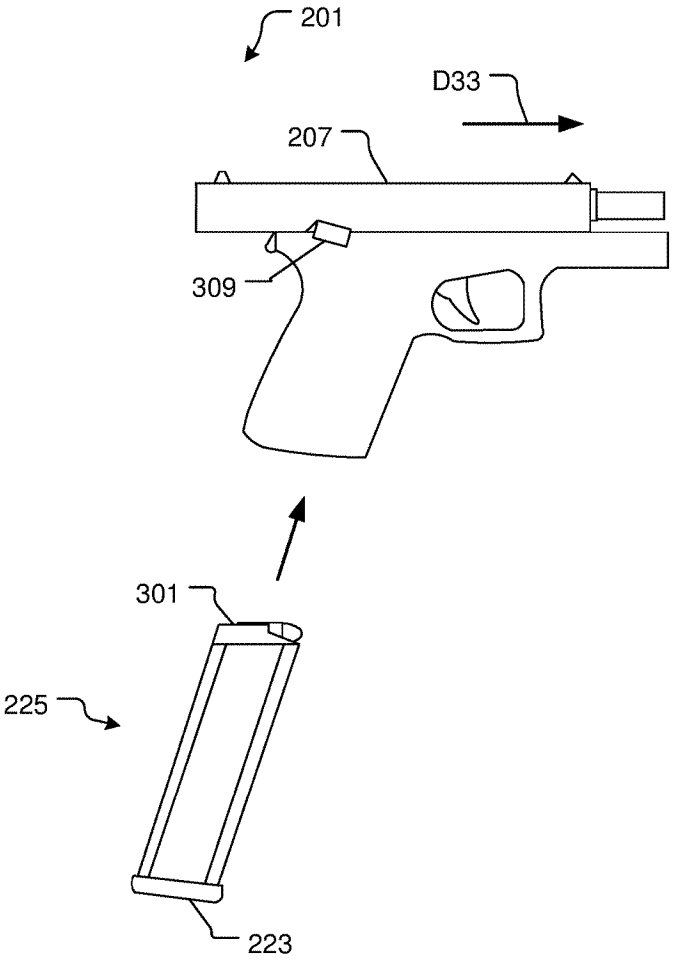
FIGS. 3A and 3B are right side views of the handgun of FIGS. 2A and 2B.
Figure 3A:
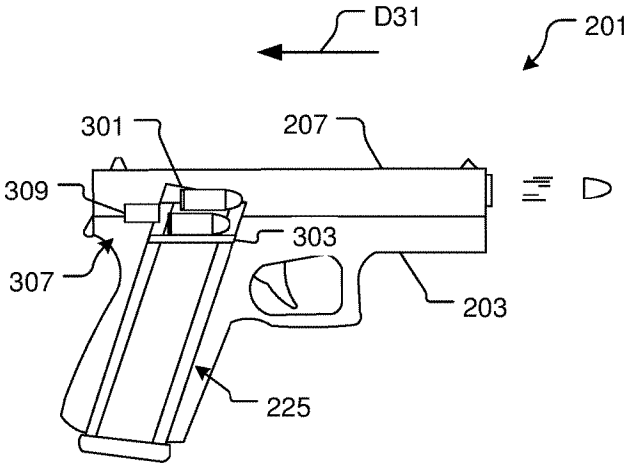

Another unique feature believed characteristic of the present application is the use of a spring-loaded locking mechanism configured to interact with both the slide and the magazine, wherein the locking mechanism is used to automatically release the slide from the open position to the closed firing position, as depicted in FIGS. 3A and 3B.

It should be understood that magazine 225 is further providing with a lip 301 configured to retain the cartridges in a ready position and a spring-loaded follower 303 slidingly engaged within the magazine and configured to move the cartridges to a fire-ready position.

As depicted in FIG. 3A, the handgun 201 is in the closed position. In this position, the lock 309 of locking mechanism 307 does not interfere with the sliding movement of slide 207, as depicted with arrows D31, D33. As the follower 303 moves upward relative to grip 205, the follower 303 eventually engages with a spring-loaded lock 309 pivotally attached to the grip 205, which in turn interlocks with slide 207 and retains the slide in the open position as the magazine 225 is automatically removed from the grip via the link system discussed above. When the magazine 225 is returned back to the interior cavity formed by grip 205, the lock 309 disengages with the slide and the slide is returned to the closed position.

Thus, the unique features believed characteristic of the present application include the combination of link system 209 and locking mechanism 307, wherein the link system 209 is configured to automatically disengage the magazine from the grip, while the locking mechanism 307 is configured to automatically return the slide to the firing position as the magazine is returned to the grip.

It should be appreciated that although the exemplary embodiment and features discussed herein are directed to a handgun, the features could also be applied to any self-loading rifle, shotgun or pistol. It should be understood that the only difference between a pistol and rifle is that a rifle has a longer barrel and a shoulder-stock, and the difference between a rifle and shotgun is that the bore of a shotgun barrel is smooth, whereas a rifle's bore has rifling grooves which impart a spin to the bullet.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A handgun having a frame integral with a grip and a slide slidingly engaged with the frame, the handgun comprising:

a locking mechanism disposed within a thickness of the grip, the locking mechanism being configured to engage with a slide stop lever associated with the slide and a magazine carried within a cavity formed by the grip; and a spring-loaded lock pivotally attached to the frame and configured to engage with a lip on a side surface of the slide, the spring-loaded lock being configured to secure the slide in a fixed, open position when engaged with the lip;

wherein the locking mechanism is configured to automatically disengage the magazine after all bullets therein are used; and wherein the spring-loaded lock is configured to release the slide as a new loaded magazine is placed in the cavity of the grip.

2. The handgun of claim 1, the locking mechanism comprising:

a first link secured to the lever; and a second link separated from the first link and secured to an attachment device associated with securing the magazine within the grip.

3. The handgun of claim 2, the second link comprising:

a first member integral with a second member;

wherein the first member is configured to engage with the first link; and wherein the second member is configured to engage with the attachment device.

4. The handgun of claim 3, wherein the second link pivots relative to the grip.

5. A method, comprising:

providing the handgun of claim 1;

disengaging the magazine after all bullets therein are used via the locking mechanism; and releasing the slide as the new loaded magazine is placed in the cavity of the grip via the spring-loaded lock.

* * * * *